US005211891A

United States Patent [19]

Anoszko

[11] Patent Number: 5,211,891

[45] Date of Patent: May 18, 1993

[54] EVAPORATIVE PAD FRAME

[75] Inventor: Thomas J. Anoszko, Oregon, Wis.

[73] Assignee: Research Products Corporation, Madison, Wis.

[21] Appl. No.: 882,117

[22] Filed: May 13, 1992

[51] Int. Cl.[5] ..... B01F 3/04

[52] U.S. Cl. ..... 261/106

[58] Field of Search ..... 261/105, 106

[56] References Cited

U.S. PATENT DOCUMENTS

| | | | |
|---|---|---|---|
| 3,823,926 | 7/1974 | Bracich | 261/106 |
| 4,045,523 | 8/1977 | Goettl | 261/106 |
| 4,158,679 | 6/1979 | Yeagle | 261/106 |
| 4,309,365 | 1/1982 | Ness et al. | 261/106 |
| 5,130,063 | 7/1992 | Collins et al. | 261/106 |

*Primary Examiner*—Tim Miles

*Attorney, Agent, or Firm*—Andrus, Sceales, Starke & Sawall

[57] ABSTRACT

A frame for holding an evaporative pad in the base of a humidifier includes side walls, base and a top that define an evaporative pad holding chamber. Each of the side walls, base and top is provided with a flange that extends inwardly toward the opening and is engageable with a lip on the base to form an air seal. The flange is provided with a rib portion that extends outwardly away from the pad chamber and is dimensioned so as to create a gap between the rib and any adjacent base surface in order to inhibit the migration of mineral deposits from the pad to the base.

5 Claims, 2 Drawing Sheets

EVAPORATIVE PAD FRAME

BACKGROUND OF THE INVENTION

The present invention relates to humidifiers and more specifically to the frame for holding the evaporative pad in the base of the humidifier.

Humidifiers that operate on the evaporative principle utilize an evaporative pad which has an extended surface. Water is introduced onto the pad surface and air is passed through the pad. The air evaporates the water on the pad and is delivered to the house or heated space. Typically, these evaporative pads are held in a frame which reduces the air bypass around the pad and contains the mineral deposits which are a by-product of the evaporative process.

After a period of use, mineral deposits or scale builds up on the surface of the pad and onto the frame holding the pad. The mineral deposits then migrate onto the base and/or housing of the humidifier.

When the evaporative pad is replaced, mineral deposits must be cleaned from the base of the humidifier. It is an object of the present invention to eliminate or reduce the migration of mineral deposits from the evaporative pad to the base of the humidifier and thus reduce or eliminate the need for cleaning of the base.

SUMMARY OF THE INVENTION

A frame for holding an evaporative pad in the base of a humidifier where the base has a centrally located generally rectangular opening defined by an inwardly extending lip, includes a pair of spaced apart substantially vertical side walls, a substantially horizontal base disposed between and connected to the side walls and a substantially horizontal top disposed between and connected to the side walls.

In accordance with one aspect of the invention, the side walls, base and top have a flange portion extending inwardly toward the opening and engageable with the base lip to form an air seal.

In accordance with another aspect of the invention, the inner edge of the flange is provided with a rib portion that extends outwardly away from the pad chamber.

In the accordance with yet another aspect of the invention, the flange and rib portions are dimensioned so as to create a gap between the rib and any adjacent base surface. This gap inhibits the migration of mineral deposits from the pad to the base.

BRIEF DESCRIPTION OF THE DRAWINGS

The drawings illustrate the best method presently contemplated of carrying out the invention.

In the drawings.

DETAILED DESCRIPTION OF THE INVENTION

Figure 1:
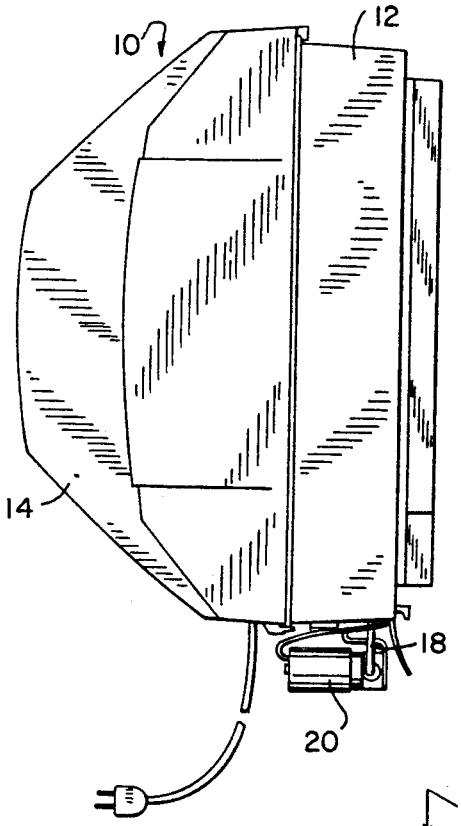
FIG. 1 is a side view of a humidifier of the type using an evaporative pad.
Figure 2:
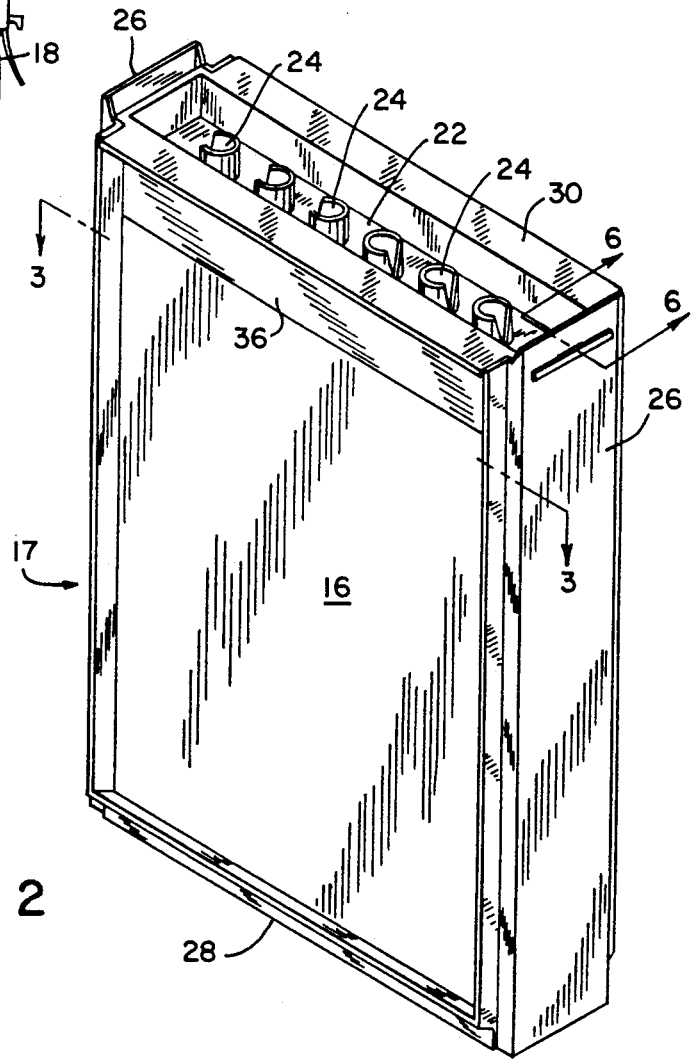
FIG. 2 is a perspective view of an evaporative pad frame constructed according to the present invention.
Figure 3:
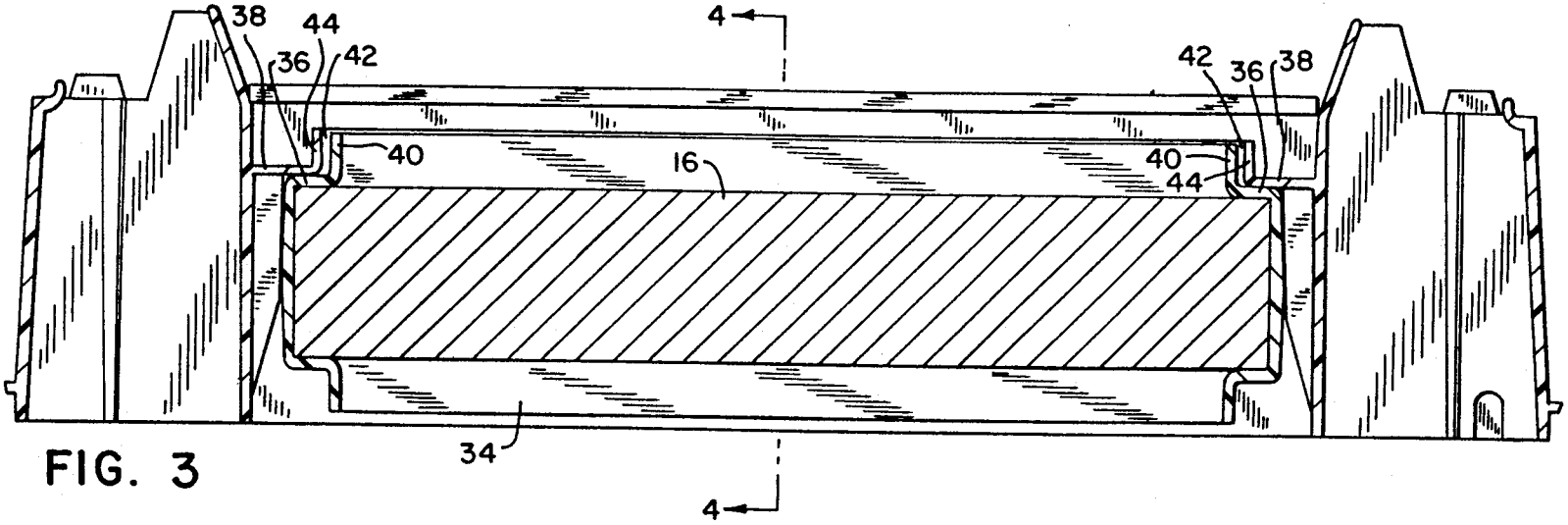
FIG. 3 is a sectional view along the line 3—3 of FIG. 2.

As seen in FIG. 1, a humidifier 10 includes a base portion 12 and a removable cover 14. An evaporative pad 16 is removably disposed within base 12. A water feed tube 18 is connected to a solenoid valve 20 and supplies water to a distribution tray 22. The water flows from distribution tray 22 through openings 24 and down through evaporative pad 16. Air is forced through evaporative pad 16 and the air evaporates the water on the pad and the humidified air is then delivered to the house or heated space. Evaporative pad 16 is held in frame 17 in order to reduce the air bypass around pad 16 and to contain the mineral deposits that build up on the evaporative pad 16 as a result of the evaporative process.

Evaporative pad frame 17 includes a pair of spaced apart side walls 26, an integral base portion 28 disposed between side walls 26 and a removable top portion 30.

Base portion 28 is provided with a drain opening 32 and top portion 30 includes the distribution tray 22 and its associated openings 24.

Side walls 26, base 28 and top 30 define a chamber 34 having a substantially rectangular opening and into which evaporative pad 16 is removably disposed.

Each of side walls 26, base 28 and top 30 is provided with a flange portion 36 that extends inwardly toward the rectangular opening.

Base 12 is provided with an inwardly extending lip 38 that defines a generally rectangular opening in base 12. Flange 36 abuts lip 38 to form a seal and reduce air bypass around pad 16. Each of flange portions 36 is provided with a rib 40. Rib 40 is integral with the inner edge of flange 36 and extends outwardly away from pad chamber 34.

Flange 36 and rib 40 are dimensioned so as to provide a gap 42 between rib 40 and an adjacent base surface 44 so that the migration of mineral deposits from pad 16 to the base surface is inhibited.

Figure 6:
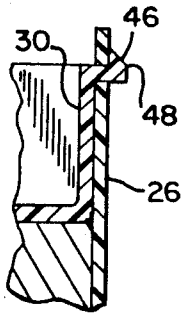
FIG. 6 is an enlarged cross-sectional view of the connection between the top and a side wall of the frame.
Figure 5:
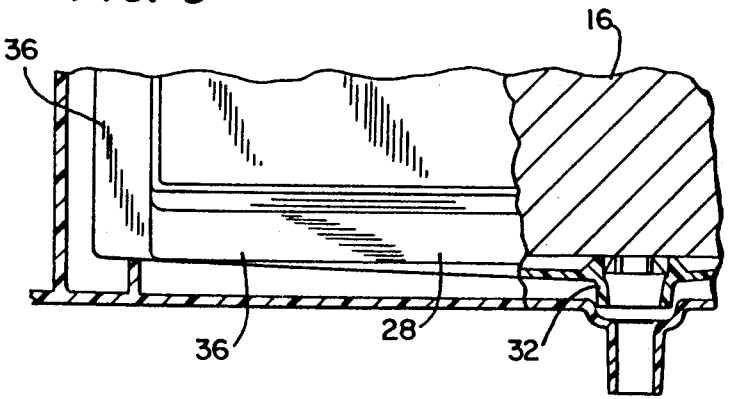
FIG. 5 is a sectional view along the line 5—5 of FIG. 4.
Figure 4:
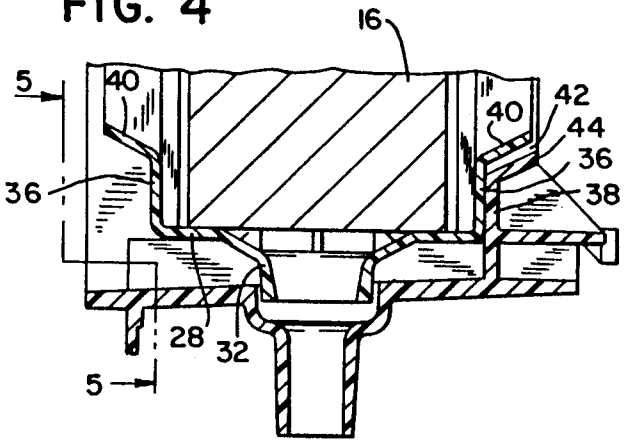
FIG. 4 is a sectional view along the line 4—4 of FIG. 3.

As seen in FIG. 6, each of side walls 26 is provided with a notch 46 adjacent its upper end. The ends of top 30 are provided with a projection 48 that is releasably engageable with notch 46. After a period of use, it is necessary to replace evaporative pad 27 and this is done by forcing side walls 26 outwardly so that projections 48 are disengaged from notches 46. Top 30 is then removed and evaporative pad 16 is slid out of frame 17. The present invention thus provides an evaporative pad frame that provides a seal between the frame and the base in order to reduce air bypass and yet provides a gap between the frame and the base so that the migration of mineral deposits between the frame and the base is inhibited.

Various modes of carrying out the invention are contemplated as being within the scope of the following claims particularly pointing out and distinctly claiming the subject matter regarded as the invention.

I claim:

1. A frame for releasably holding an evaporative pad in the base of a humidifier wherein the base has a centrally located generally rectangular opening defined by an inwardly extending lip, said frame comprising a pair of spaced apart substantially vertical side walls, a substantially horizontal base disposed between and connected to said side walls, a substantially horizontal top disposed between and connected to said side walls, said side walls, base and top defining a chamber in which the evaporative pad is disposed and having a substantially rectangular opening, and each of said side walls, base and top having a flange portion extending inwardly toward said opening and engageable with the base lip to form an air seal and a rib portion disposed at the inner edge of said flange and extending outwardly away from the pad chamber, said flange and rib portions dimensioned so as to create a gap between said rib and any adjacent base surface in order to inhibit the migration of mineral deposits from the pad to the base.

2. The frame defined in claim 1 wherein said base includes a drain opening.

3. The frame defined in claim 1 wherein said top includes a water distribution tray having openings to distribute water across the top of the pad.

4. The frame defined in claim 1 wherein said top is removably disposed between said side walls.

5. The frame defined in claim 4 wherein each of said side walls is provided with a notch adjacent its upper end and said top is provided a pair of projections releasably engageable with said side wall notches.

* * * * *